US011313580B2

(12) United States Patent
Yano et al.

(10) Patent No.: US 11,313,580 B2
(45) Date of Patent: Apr. 26, 2022

(54) DUCT

(71) Applicant: MITSUBISHI HEAVY INDUSTRIES, LTD., Tokyo (JP)

(72) Inventors: Yuki Yano, Tokyo (JP); Nobuyuki Kamihara, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 28 days.

(21) Appl. No.: 17/083,983

(22) Filed: Oct. 29, 2020

(65) Prior Publication Data

US 2021/0148599 A1 May 20, 2021

(30) Foreign Application Priority Data

Nov. 19, 2019 (JP) ..... JP2019-208953

(51) Int. Cl.
*F24F 13/02* (2006.01)

(52) U.S. Cl.
CPC ..... *F24F 13/0263* (2013.01)

(58) Field of Classification Search
CPC ..... F24F 13/0263
USPC ..... 138/103
See application file for complete search history.

(56) References Cited

U.S. PATENT DOCUMENTS 2,511,896 A * 6/1950 Bingley ..... H01P 3/14 138/139
2,785,382 A * 3/1957 Lamb ..... H01P 3/14 333/241
3,136,965 A * 6/1964 Clarence ..... H01P 3/123 333/239
4,020,875 A * 5/1977 Akiba ..... H01P 3/12 138/128
4,071,834 A * 1/1978 Comte ..... G02B 6/4458 138/122
4,555,422 A * 11/1985 Nakamura ..... B29C 61/0616 138/103
6,064,000 A * 5/2000 Kim ..... H01R 4/726 138/138
6,310,284 B1 * 10/2001 Ikeda ..... H02G 3/0468 138/121

(Continued)

FOREIGN PATENT DOCUMENTS

| | | |
|---|---|---|
| JP | 2003-300500 | 10/2003 |
| JP | 2010-14358 | 1/2010 |
| JP | 2020-122616 | 8/2020 |

*Primary Examiner* — Craig M Schneider
*Assistant Examiner* — David R Deal
(74) *Attorney, Agent, or Firm* — Wenderoth, Lind & Ponack, L.L.P.

(57) ABSTRACT

A duct includes: a tube that is formed to extend from an indoor of a building or a movable body and that allows an outside and the indoor to communicate with each other; an electromagnetic wave inhibiting sloped surface that is formed on an inner surface of the tube and extends to be sloped to approach an axial line of the tube from the outside toward the indoor in an axial direction of the tube and that reflects an electromagnetic wave; and an electromagnetic wave selecting inner peripheral member that has a tubular shape covering the electromagnetic wave inhibiting sloped surface from an inner peripheral side and is capable of selectively transmitting only an electromagnetic wave of a specific frequency incident on the tube.

19 Claims, 4 Drawing Sheets

(56) References Cited

U.S. PATENT DOCUMENTS

| | | | | |
|---|---|---|---|---|
| 6,872,888 | B2 * | 3/2005 | Santelli, Jr. | H02G 3/0468 138/118 |
| 9,386,733 | B2 * | 7/2016 | Adachi | H01B 7/228 |
| 9,437,351 | B2 * | 9/2016 | Sugiyama | H02G 3/0468 |
| 2014/0374134 | A1 * | 12/2014 | Itani | F16L 9/02 174/68.3 |
| 2015/0294765 | A1 * | 10/2015 | Katsumata | F16L 57/00 174/15.6 |

* cited by examiner

DUCT

CROSS-REFERENCE TO RELATED APPLICATIONS

This application claims the benefit of priority to Japanese Patent Application Number 2019-208953 filed on Nov. 19, 2019. The entire contents of the above-identified application are hereby incorporated by reference.

TECHNICAL FIELD

The present disclosure relates to a duct.

RELATED ART

Buildings and movable bodies, such as nuclear power plants, thermal power plants, aircrafts, naval vessels, and automobiles, in which various types of electrical devices are accommodated indoors, are provided with ducts that communicate indoors with outside. For example, the outside air is taken in and exhausted through the duct. On the other hand, by providing such a duct, external electromagnetic wave may inadvertently intrude the indoor. Therefore, attempts have been made to shield the electromagnetic wave by using the techniques described in the following JP 2010-14358 A and JP 2003-300500 A.

JP 2010-14358 A and JP 2003-3005) A disclose a configuration in which an electromagnetic wave absorbing member configured to absorb electromagnetic waves (radiation noise) being noise is provided on an inner surface of a duct. In this configuration, the radiation noise intruding the duct from the outside is absorbed by the electromagnetic wave absorbing member, thereby suppressing the radiation noise from intruding the indoor.

SUMMARY

However, in the configurations described above in JP 2010-14358 A and JP 2003-300500 A, the structure is arranged so as to protrude inward from the inner peripheral surface of the duct. As a result, flow of a fluid through the duct is inhibited, and a pressure loss may occur. Further, in the devices according to JP 2010-14358 A and JP 2003-300500 A, although electromagnetic waves of all frequencies are absorbed by the electromagnetic wave absorbing member, there is also a demand that electromagnetic waves of a specific frequency band are transmitted.

The present disclosure has been made to solve the above-described problems, and an object of the present disclosure is to provide a duct capable of realizing smooth flow of a fluid and selective transmission of electromagnetic waves.

In order to solve the above problems, a duct according to the present disclosure includes: a tube that is formed to extend from an indoor of a building or a movable body and that allows an outside and the indoor to communicate with each other; an electromagnetic wave inhibiting sloped surface that is formed on an inner surface of the tube and extends to be sloped to approach an axial line of the tube from the outside toward the indoor in an axial direction of the tube and that reflects an electromagnetic wave; and an electromagnetic wave selecting inner peripheral member that has a tubular shape covering the electromagnetic wave inhibiting sloped surface from an inner peripheral side and is capable of selectively transmitting only an electromagnetic wave of a specific frequency incident on the tube.

According to the duct of the present disclosure, smooth flow of a fluid and selective transmission of electromagnetic waves can be realized.

BRIEF DESCRIPTION OF DRAWINGS

The disclosure will be described with reference to the accompanying drawings, wherein like numbers reference like elements.

DESCRIPTION OF EMBODIMENTS

First Embodiment

Configuration of Duct

Hereinafter, a duct according to a first embodiment of the present disclosure will be described with reference to FIGS. 1 and 2.

Figure 1:
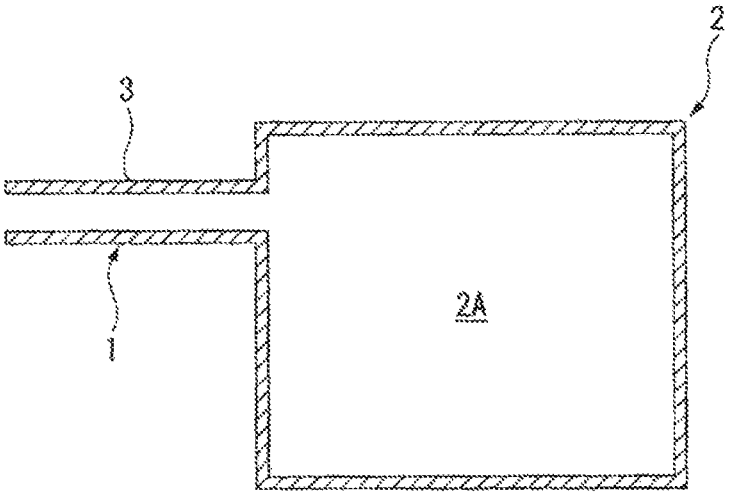
FIG. 1 is a diagram illustrating an example of a building and a duct connected to the building.

As illustrated in FIG. 1, the duct 1 according to the present embodiment includes a tube 3. The tube 3 is formed to extend from the indoor 2A of the building 2, and communicates outside of the building 2 with the indoor 2A. Various devices (not illustrated) that may be affected by electromagnetic waves (radiation noise) are disposed in the indoor 2A of the building 2. The wall part of the building 2 shields electromagnetic waves propagating to the outside of the building 2. The building 2 may be a building of various plants such as a nuclear power plant and a thermal power plant, or may be a residential house, a factory, a warehouse, or the like.

Figure 2:
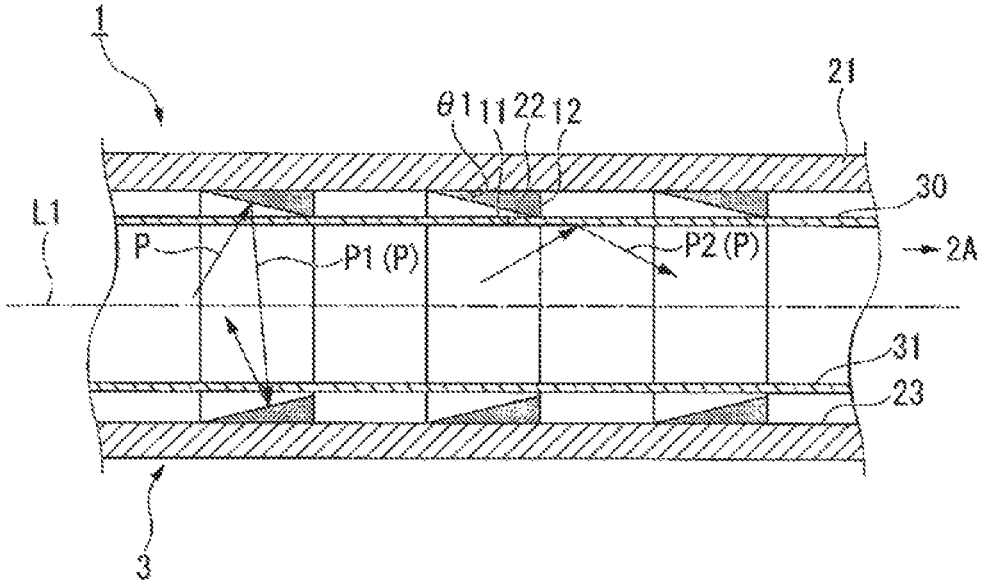
FIG. 2 is a cross-sectional view illustrating a configuration of a duct according to a first embodiment of the present disclosure.

As illustrated in FIG. 2, the tube 3 includes a tube body 21 formed in a tubular shape, an electromagnetic wave inhibiting portion 22 constituting an electromagnetic wave inhibiting sloped surface 11, and an electromagnetic wave selecting inner peripheral member 30. The electromagnetic wave inhibiting portion 22 is fixed to the inner peripheral surface 23 of the tube body 21.

Configuration of Electromagnetic Wave Inhibiting Portion

In the present embodiment, the inner peripheral surface 23 of the tube body 21, which forms the inner surface of the tube 3, is parallel to the axial line L1 of the tube 3. The electromagnetic wave inhibiting portion 22 of the present embodiment includes an electromagnetic wave inhibiting sloped surface 11 and a vertical surface 12, which form the inner surface of the tube 3. In the cross section illustrated in FIG. 2, the electromagnetic wave inhibiting portion 22 is formed in a right triangle of which hypotenuse is the electromagnetic wave inhibiting sloped surface 11.

The electromagnetic wave inhibiting sloped surface 11 is a surface capable of reflecting electromagnetic waves at least. The electromagnetic wave inhibiting sloped surface 11 extends in a sloped manner so as to approach the axial line L1 of the tube 3 from the outside toward the indoor 2A in the axial direction of the tube 3. The electromagnetic wave inhibiting sloped surface 11 is located at a distance from the axial line L1 of the tube 3 so as not to excessively inhibit the air flow in the tube 3. In the cross section illustrated in FIG. 2, the electromagnetic wave inhibiting sloped surface 11 extends linearly. That is, the slope angle θ1 of the electromagnetic wave inhibiting sloped surface 11 with respect to the axial line L1 of the tube 3 is constant in the axial direction of the tube 3.

The slope angle θ1 of the electromagnetic wave inhibiting sloped surface 11 may be at least larger than 0 degrees and smaller than 90 degrees. The slope angle θ1 of the electromagnetic wave inhibiting sloped surface 11 is more preferably, for example, not less than 10 degrees. The slope angle θ1 of the electromagnetic wave inhibiting sloped surface 11 is more preferably, for example, not greater than 45 degrees.

The vertical surface 12 of the electromagnetic wave inhibiting portion 22 extends in a direction orthogonal to the axial line L1 so as to be separated from the axial line L1 with respect to one end of the electromagnetic wave inhibiting sloped surface 11 positioned on the indoor 2A side in the axial direction of the tube 3.

In the present embodiment, the axial line L1 of the tube 3 extends linearly. That is, the tube 3 extends linearly. The axial line L1 of the tube 3 may be curved, for example. That is, the tube 3 may be curved in a U-shape or an S-shape, for example.

A pair of electromagnetic wave inhibiting sloped surfaces 11 (electromagnetic wave inhibiting portions 22) are disposed facing each other in a direction orthogonal to the axial line L1 of the tube 3. The pair of electromagnetic wave inhibiting sloped surfaces 1 are disposed at positions that coincide with each other in the axial direction of the tube 3. Specifically, the lengths of the electromagnetic wave inhibiting sloped surfaces 11 in the axial direction of the tube 3 are equal to each other between the pair of electromagnetic wave inhibiting sloped surfaces 11. Further, positions of both ends of the pair of electromagnetic wave inhibiting sloped surfaces 11 in the axial direction of the tube 3 coincide with each other. In the present embodiment, the slope angles θ1 of the pair of electromagnetic wave inhibiting sloped surfaces 11 coincide with each other.

The electromagnetic wave inhibiting sloped surface 11 may be formed, for example, in the entire circumferential direction of the tube 3.

The number of the pair of electromagnetic wave inhibiting sloped surfaces 11 (electromagnetic wave inhibiting portions 22) may be one, for example. In the present embodiment, a plurality of pairs of electromagnetic wave inhibiting sloped surfaces 11 are arranged in the axial direction of the tube 3. For example, as illustrated in FIG. 2, the plurality of pairs of electromagnetic wave inhibiting sloped surfaces 11 may be arranged at intervals in the axial direction of the tube 3. The slope angle θ1 of the electromagnetic wave inhibiting sloped surface 11 and the interval between the electromagnetic wave inhibiting sloped surfaces 11 and the axial line L1 of the tube 3 may be different from each other among the plurality of electromagnetic wave inhibiting sloped surfaces 1 arranged in the axial direction of the tube 3, but are equal in the present embodiment.

The electromagnetic wave inhibiting portion 22 of the present embodiment is configured by an electromagnetic wave absorber configured to absorb electromagnetic waves. The electromagnetic wave absorber is made of a material capable of absorbing electromagnetic waves, such as a metal material, a metal oxide material (e.g., ferrite), or a conductive polymeric material.

In the present embodiment, the pair of electromagnetic wave inhibiting portions 22 forming the pair of electromagnetic wave inhibiting sloped surfaces 11 are integrally formed. The pair of electromagnetic wave inhibiting portions 22 forming the pair of electromagnetic wave inhibiting sloped surfaces 1 are integrally formed by being connected to each other by a connection portion (not illustrated) or by the electromagnetic wave inhibiting portions 22 being formed over the entire circumferential direction of the tube body 21. The pair of electromagnetic wave inhibiting portions 22 may be formed separately, for example.

Configuration of Electromagnetic Wave Selecting Inner Peripheral Member

An electromagnetic wave selecting inner peripheral member 30 is provided on the inner peripheral side of the electromagnetic wave inhibiting portion 22. The electromagnetic wave selecting inner peripheral member 30 can selectively transmit only electromagnetic waves of a specific frequency. Specifically, a material called Frequency Selective Surface (FSS) is suitably used as the electromagnetic wave selecting inner peripheral member 30. The type of FSS is appropriately selected according to the frequency to be transmitted. An electromagnetic wave selecting inner peripheral member 30 formed of FSS has a cylindrical shape around an axial line L1. The outer peripheral surface of the electromagnetic wave selecting inner peripheral member 30 is supported and fixed by the end edge on the inner peripheral side of the electromagnetic wave inhibiting portion 22. Specifically, the electromagnetic wave selecting inner peripheral member 30 may be bonded and fixed to the electromagnetic wave inhibiting portion 22. The electromagnetic wave inhibiting sloped surface 11 is covered from the inner peripheral side by the electromagnetic wave selecting inner peripheral member 30.

Operational Effects

According to the duct 1 of the present embodiment, the pair of electromagnetic wave inhibiting sloped surfaces 11 opposed to each other in the direction orthogonal to the axial line L1 of the tube 3 are disposed at positions coinciding with each other in the axial direction of the tube 3. Thus, it is possible to effectively reduce electromagnetic waves (radiation noise) intruding the indoor 2A through the duct 1. This point will be described below.

For example, as illustrated in FIG. 2, in the duct 1 of the present embodiment, an electromagnetic wave P1 as noise traveling from the outside to the indoor 2A inside the tube 3 passes through the electromagnetic wave selecting inner peripheral member and is incident on the electromagnetic wave inhibiting sloped surface 11. When the electromagnetic wave P1 is reflected by one electromagnetic wave inhibiting sloped surface 11 of the pair of electromagnetic wave inhibiting sloped surfaces 11, the electromagnetic wave P1 is likely to travel toward the other electromagnetic wave inhibiting sloped surface 11. Accordingly, the electromagnetic wave P1 is further reflected by the other electromagnetic wave inhibiting sloped surface 11, and is likely to travel toward the external side of the duct 1 (the left side in FIG. 2). That is, it is possible to suppress the electromagnetic wave P from traveling toward the indoor 2A in the duct 1. Further, the electromagnetic wave P1 is reflected by the pair of electromagnetic wave inhibiting sloped surfaces 11 for a plurality of times, so that the electromagnetic wave P1 can be suitably attenuated. Thus, it is possible to effectively reduce the intrusion of the electromagnetic wave P into the indoor 2A through the duct 1.

Thus, various devices arranged in the indoor 2A of the building 2 can be protected from electromagnetic waves (radiation noise).

On the other hand, the electromagnetic wave P2 of another frequency reflected by the electromagnetic wave selecting inner peripheral member 30 without passing through the electromagnetic wave selecting inner peripheral member 30 is repeatedly reflected in the extending direction of the tube 3, and reaches the other end side (indoor 2A side) from one end side of the duct. That is, only electromagnetic waves of frequencies that are not desired to be shielded can reach the indoor through the duct.

Further, in the above configuration, since the electromagnetic wave selecting inner peripheral member 30 is provided on the inner peripheral side, no projection is formed on the inner peripheral surface side of the tube 3. Thus, the flow of the air or the like originally flowing through the duct 1 can smoothly flow while the pressure loss is suppressed. Thus, smooth flow of the fluid and selective transmission of the electromagnetic wave can be realized at the same time.

In addition, according to the duct 1 of the present embodiment, the electromagnetic wave inhibiting portion 22 constituting the electromagnetic wave inhibiting sloped surface 11 is fixed to the inner peripheral surface 23, of the tube body 21, which extends parallel to the axial line L1 of the tube 3. Therefore, the electromagnetic wave inhibiting sloped surface 11 can be easily formed on the duct 1 (the tube body 21) that does not include the electromagnetic wave inhibiting sloped surface 11.

Further, according to the duct 1 of the present embodiment the electromagnetic wave inhibiting portion 22 is constituted by the electromagnetic wave absorber. Therefore, the electromagnetic wave can be not only reflected but also absorbed by the electromagnetic wave inhibiting portion 22. That is, electromagnetic waves intruding the duct 1 from the outside can be attenuated more effectively in the electromagnetic wave inhibiting portion 22. Therefore, it is possible to more effectively reduce electromagnetic waves from intruding the indoor 2A through the duct 1.

Further, according to the duct 1 of the present embodiment the pair of electromagnetic wave inhibiting portions 22 respectively constituting the pair of electromagnetic wave inhibiting sloped surfaces 11 are integrally formed. Therefore, when the pair of electromagnetic wave inhibiting portions 22 are provided on the inner peripheral surface 23 of the tube body 21, the pair of electromagnetic wave inhibiting sloped surfaces 11 can be reliably prevented from being displaced from each other in the axial direction of the tube 3. That is, when the pair of electromagnetic wave inhibiting portions 22 are provided on the inner peripheral surface 23 of the tube body 21, the pair of electromagnetic wave inhibiting sloped surfaces 1 can be easily positioned relative to each other.

According to the duct 1 of the present embodiment, the plurality of pairs of electromagnetic wave inhibiting sloped surfaces 11 are arranged in the axial direction of the tube 3. Therefore, in the duct 1, an electromagnetic wave traveling from the outside to the indoor 2A can be reflected by another electromagnetic wave inhibiting sloped surface 11 located on the indoor 2A side even when not reflected by one pair of electromagnetic wave inhibiting sloped surfaces 11 located on the external side. Accordingly, it is possible to further reduce the intrusion of electromagnetic waves into the indoor 2A.

In addition, according to the duct 1 of the present embodiment, the electromagnetic wave inhibiting sloped surface 11, which extends in a sloped manner so as to approach the axial line L1 of the tube 3 from the outside toward the indoor 2A in the axial direction of the tube 3, is positioned at a distance from the axial line L1 of the tube 3. The slope angle θ1 of the electromagnetic wave inhibiting sloped surface 11 is smaller than 90 degrees. For this reason, it is possible to suppress the occurrence of turbulence in the air flow in the tube 3 and to suppress the pressure loss of the flow of air in the tube 3 to be small. In particular, the pressure loss of the air flow flowing from the outside toward the indoor 2A side in the tube 3 can be reduced. When the slope angle θ1 of the electromagnetic wave inhibiting sloped surface 11 is not greater than 45 degrees, the occurrence of turbulence in the air flow in the tube 3 can be further suppressed, and the pressure loss of the air flow can be further reduced.

Second Embodiment

Figure 3:
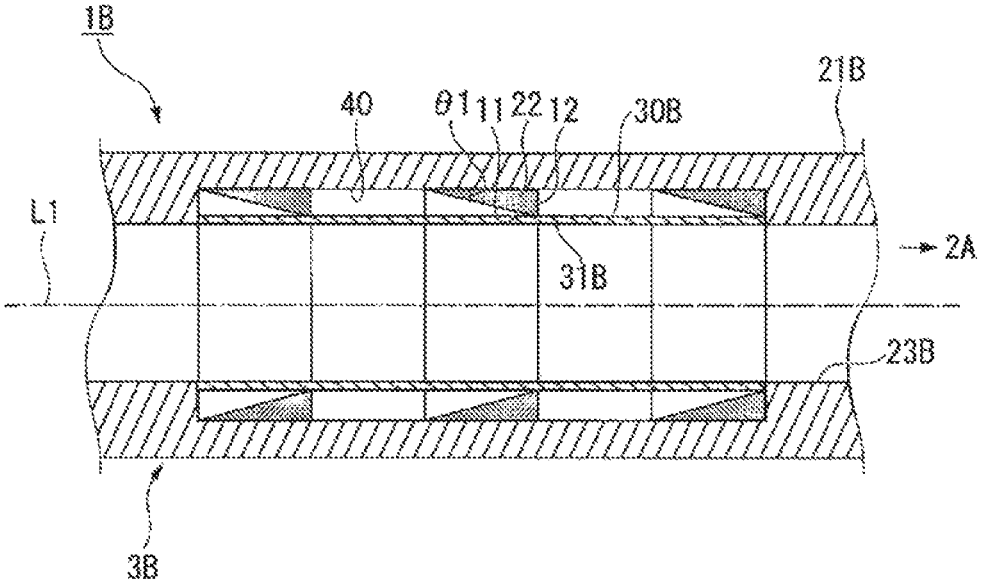
FIG. 3 is a cross-sectional view illustrating a configuration of a duct according to a second embodiment of the present disclosure.

Next, a second embodiment of the present disclosure will be described with reference to FIG. 3. The same components as those of the first embodiment are denoted by the same reference signs, and a detailed description thereof will be omitted. As illustrated in the drawing, in the duct 1B according to the present embodiment, a housing recess 40 is formed in the inner peripheral surface 23B of the tube body 21B, and an electromagnetic wave inhibiting portion 22 similar to that described above is housed in the housing recess 40. To be specific, the housing recess 40 has a rectangular cross-sectional shape that is recessed from the inner peripheral surface 23B of the tube body 21B toward the outer peripheral side. The depth of the housing recess 40 (i.e., the dimension in the radial direction with respect to the axial line L1) is set to be slightly larger than the height dimension of the electromagnetic wave inhibiting portion 22.

Further, the housing recess 40 is covered with an electromagnetic wave selecting inner peripheral member 30B from the inner peripheral side. The inner peripheral surface 31B of the electromagnetic wave selecting inner peripheral member 30B and the inner peripheral surface 23B of the tube body 21B are flush with each other. Note that these surfaces do not have to be completely flush with each other, and a slight error is allowed as long as it is aimed that substantially no step is formed.

According to the above configuration, the electromagnetic wave inhibiting sloped surface 11 is accommodated in the housing recess 40, and further the housing recess 40 is covered with the electromagnetic wave selecting inner peripheral member 30B from the inner peripheral side. Therefore, no projection is formed on the inner peripheral surface 23B side of the duct 1B (tube body 21B). Thus, the flow of the air or the like originally flowing through the duct 1B can smoothly flow while the pressure loss is suppressed.

Further, according to the above-described configuration, since the inner peripheral surface 23B of the tube body 21B and the inner peripheral surface 318 of the electromagnetic wave selecting inner peripheral member 30B are flush with each other, the flow of air or the like flowing through the duct 1B is allowed to flow more smoothly while pressure loss is suppressed.

Third Embodiment

Figure 4:
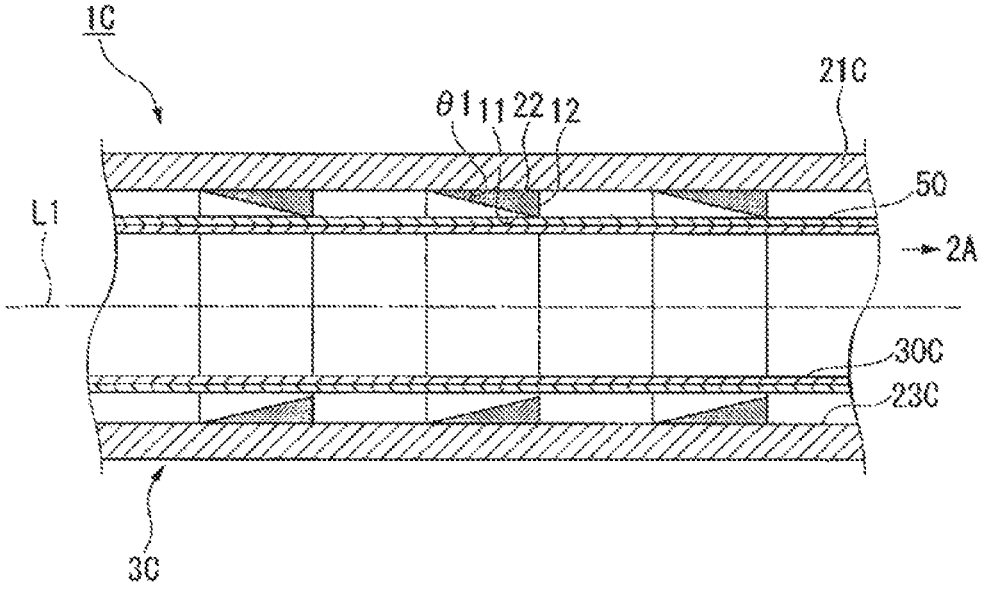
FIG. 4 is a cross-sectional view illustrating a configuration of a duct according to a third embodiment of the present disclosure.

Next, a third embodiment of the present disclosure will be described with reference to FIG. 4. The same components as those in the above embodiments are denoted by the same reference signs, and a detailed description thereof will be omitted. As illustrated in the drawing, the duct 1C according to the present embodiment further includes a reinforcing member 50 in addition to the components described in the first embodiment. The reinforcing member 50 is provided for the purpose of reinforcing the electromagnetic wave selecting inner peripheral member 30C. The reinforcing member 50 has a tubular shape covering the electromagnetic wave selecting inner peripheral member 30C from the outer peripheral side. The inner peripheral surface of the reinforcing member 50 is in contact with the outer peripheral surface of the electromagnetic wave selecting inner peripheral member 30C without a gap. That is, the inner diameter of the reinforcing member 50 is set equal to or slightly larger than the outer diameter of the electromagnetic wave selecting inner peripheral member 30C. A metal mesh is preferably used as the reinforcing member 50. The outer peripheral surface of the reinforcing member 50 is supported and fixed, by an adhesive or the like, to the end edge on the inner peripheral side of the electromagnetic wave inhibiting portion 22.

According to the above-described configuration, in addition to the same operational effects as those described in the above-described first embodiment, it is possible to further improve the durability of the duct by reinforcing the electromagnetic wave selecting inner peripheral member 30C with the reinforcing member 50.

Other Embodiments

The embodiment of the present invention has been described above in detail with reference to the drawings, but the specific configurations are not limited to those embodiments, and design changes or the like that do not depart from the scope of the disclosure are also included. For example, it is also possible to adopt a configuration further including a honeycomb shield provided in the opening on the external side of the tube 3 (3B, 3C). The honeycomb shield is configured by forming a large number of through holes in a plate member capable of reflecting electromagnetic waves. When the duct of the present invention includes the honeycomb shield, it is possible to suppress electromagnetic waves from entering the tube, and thus it is possible to more effectively reduce intrusion of electromagnetic waves into the indoor through the duct. In addition, for example, a honeycomb shield provided in the opening on the external side of the tube 3 may be further provided. The honeycomb shield is configured by forming a large number of through holes in a plate member capable of reflecting electromagnetic waves. According to this configuration, it is possible to more effectively reduce intrusion of electromagnetic waves into the indoor through the duct 1. The tube 3 may be formed to extend from the indoor of a movable body such as an aircraft or an automobile.

Notes

The duct described in each embodiment is grasped as follows, for example.

(1) A duct 1 according to a first aspect includes: a tube 3 that is formed to extend from an indoor of a building or a movable body and that allows an outside and the indoor 2A to communicate with each other; an electromagnetic wave inhibiting sloped surface 11 that is formed on an inner surface of the tube 3 and extends to be sloped to approach an axial line L1 of the tube 3 from the outside toward the indoor 2A in an axial direction of the tube 3 and that reflects an electromagnetic wave; and an electromagnetic wave selecting inner peripheral member 30 that has a tubular shape covering the electromagnetic wave inhibiting sloped surface 11 from an inner peripheral side and is capable of selectively transmitting only an electromagnetic wave of a specific frequency incident on the tube 3.

According to the above configuration, electromagnetic waves of a specific frequency pass through the electromagnetic wave selecting inner peripheral member 30 and is incident on the electromagnetic wave inhibiting sloped surface 11. When the electromagnetic wave is reflected by one electromagnetic wave inhibiting sloped surface 11 of the pair of electromagnetic wave inhibiting sloped surfaces 11, the electromagnetic wave is likely to travel toward the other electromagnetic wave inhibiting sloped surface 11. Thus, the electromagnetic wave is further reflected by the other electromagnetic wave inhibiting sloped surface 11, and is likely to travel toward the external side of the duct 1. That is, it is possible to suppress the electromagnetic wave from traveling toward the indoor through the duct 1. Further, the electromagnetic wave is reflected by the pair of electromagnetic wave inhibiting sloped surfaces 11 for a plurality of times, so that the electromagnetic wave can be suitably attenuated.

On the other hand, the electromagnetic wave of another frequency reflected by the electromagnetic wave selecting inner peripheral member 30 without passing through the electromagnetic wave selecting inner peripheral member 30 is repeatedly reflected in the extending direction of the duct 1, and reaches the other end side from one end side of the duct 1. That is, only electromagnetic waves of frequencies that are not desired to be shielded can reach the indoor 2A through the duct 1.

Further, in the above configuration, since the electromagnetic wave selecting inner peripheral member 30 is provided on the inner peripheral side, no projection is formed on the inner peripheral surface 23 side of the duct 1. Thus, the flow of the air or the like originally flowing through the duct 1 can smoothly flow while the pressure loss is suppressed.

(2) In a duct 1B according to a second aspect, the tube 3B is formed with a housing recess 40 that is recessed front the inner peripheral surface of the tube 3 toward an outer peripheral side, the electromagnetic wave inhibiting sloped surface 11 extends from an inner peripheral surface of the housing recess 40 and is accommodated in the housing recess 40, and the electromagnetic wave selecting inner peripheral member 30B covers the housing recess 40 from an inner peripheral side.

According to the above configuration, the electromagnetic wave inhibiting sloped surface 11 is accommodated in the housing recess 40, and the housing recess 40 is covered with the electromagnetic wave selecting inner peripheral member 30B from the inner peripheral side. Therefore, no projection is formed on the inner peripheral surface 23B side of the duct 1B. Thus, the flow of the air or the like originally flowing through the duct 1B can smoothly flow while the pressure loss is suppressed.

(3) In a duct 1B according to a third aspect, an inner peripheral surface 238 of the tube 3B and an inner peripheral surface 31B of the electromagnetic wave selecting inner peripheral member 30B are flush with each other.

According to the above-described configuration, since the inner peripheral surface 23B of the tube 3B and the inner peripheral surface 31B of the electromagnetic wave selecting inner peripheral member 30B are flush with each other, the flow of air or the like flowing through the duct 1B is allowed to flow more smoothly while pressure loss is suppressed.

(4) A duct 1C according to a fourth aspect further includes a reinforcing member 50 that has a tubular shape covering the electromagnetic wave selecting inner peripheral member 30C from an outer peripheral side and that reinforces the electromagnetic wave selecting inner peripheral member 30C.

According to the above configuration, it is possible to further improve the durability of the duct 1C by reinforcing the electromagnetic wave selecting inner peripheral member 30C with the reinforcing member 50.

(5) In a duct 1 (1B, 1C) according to a fifth aspect, a pair of the electromagnetic wave inhibiting sloped surfaces 11 are disposed facing each other in a direction orthogonal to the axial line L1, and the pair of electromagnetic wave inhibiting sloped surfaces 11 are disposed at positions that coincide with each other in an axial direction of the tube 3 (3B, 3C).

According to the above configuration, it is possible to realize the inhibition of the electromagnetic wave by the electromagnetic wave inhibiting sloped surface 11 in a wider range in the direction orthogonal to the axial line L1.

(6) In a duct 1 (1B, 1C) according to a sixth aspect, the tube 3 (3B, 3C) includes: a tube body 21 (21B, 21C) including an inner peripheral surface 23 (23B. 23C) parallel to the axial line L1; an electromagnetic wave inhibiting portion 22 that is fixed to an inner peripheral surface 23 (23B, 23C) of the tube body 21 (21B, 21C) and that forms the electromagnetic wave inhibiting sloped surface 11.

According to the above-described configuration, the electromagnetic wave inhibiting sloped surface 11 can be easily formed in the duct (tube body 21(21B, 21C)) that does not include the electromagnetic wave inhibiting sloped surface 11.

(7) in a duct (1B, 1C) according to a seventh aspect, the electromagnetic wave inhibiting portion 22 is formed of an electromagnetic wave absorber that absorbs electromagnetic waves.

According to the above configuration, the electromagnetic wave can be not only reflected but also absorbed by the electromagnetic wave inhibiting portion 22. That is, electromagnetic waves entering the duct 1 (1B, 1C) from the outside can be attenuated more effectively in the electromagnetic wave inhibiting portion 22. Therefore, it is possible to more effectively reduce electromagnetic waves from entering the indoor through the duct 1 (1B, 1C).

(8) in a duct 1 (1B, 1C) according to an eighth aspect, the tube 3 (38, 3C) includes: a tube body 21 (21B, 21C); and an electromagnetic wave inhibiting portion 22 that is fixed to an inner peripheral surface 23 (23B, 23C) of the tube body 21 (21B, 21C) and that forms the electromagnetic wave inhibiting sloped surface 11, and the electromagnetic wave inhibiting portion 22 is formed of an electromagnetic wave absorber that absorbs electromagnetic waves.

According to the above configuration, the electromagnetic wave can be not only reflected but also absorbed by the electromagnetic wave inhibiting portion 22. That is, electromagnetic waves entering the duct 1 (1B, 1C) from the outside can be attenuated more effectively in the electromagnetic wave inhibiting portion 22. Therefore, it is possible to more effectively reduce electromagnetic waves from entering the indoor through the duct 1 (1B, 1C).

(9) In a duct 1 (1B, 1C) according to a ninth aspect, a plurality of pairs of the electromagnetic wave inhibiting sloped surfaces 11 are arranged in the axial direction.

According to the above-described configuration, inside the tube 3 (3B, 3C), an electromagnetic wave traveling from the outside to the indoor 2A can be reflected by another electromagnetic wave inhibiting sloped surface 11 located on the indoor 2A side even when not reflected by one pair of electromagnetic wave inhibiting sloped surfaces 11 located on the external side. Accordingly, it is possible to further reduce the intrusion of electromagnetic waves into the indoor 2A.

While preferred embodiments of the invention have been described as above, it is to be understood that variations and modifications will be apparent to those skilled in the an without departing from the scope and spirit of the invention. The scope of the invention, therefore, is to be determined solely by the following claims.

The invention claimed is:

1. A duct comprising:

a tube that is formed to extend from an indoor of a building or a movable body and that allows an outside and the indoor to communicate with each other;

an electromagnetic wave inhibiting sloped surface that is formed on an inner surface of the tube and extends to be sloped to approach an axial line of the tube from the outside toward the indoor in an axial direction of the tube and that reflects an electromagnetic wave; and an electromagnetic wave selecting inner peripheral member that has a tubular shape covering the electromagnetic wave inhibiting sloped surface from an inner peripheral side and is capable of selectively transmitting only an electromagnetic wave of a specific frequency incident on the tube.

2. The duct according to claim 1, wherein the tube is formed with a housing recess that is recessed from an inner peripheral surface of the tube toward an outer peripheral side, the electromagnetic wave inhibiting sloped surface extends from the inner peripheral surface of the housing recess and is accommodated in the housing recess, and the electromagnetic wave selecting inner peripheral member covers the housing recess from an inner peripheral side.

3. The duct according to claim 2, wherein the inner peripheral surface of the tube and an inner peripheral surface of the electromagnetic wave selecting inner peripheral member are flush with each other.

4. The duct according to claim 2, further comprising a reinforcing member that has a tubular shape covering the electromagnetic wave selecting inner peripheral member from an outer peripheral side and that reinforces the electromagnetic wave selecting inner peripheral member.

5. The duct according to claim 2, wherein a pair of the electromagnetic wave inhibiting sloped surfaces are disposed facing each other in a direction orthogonal to the axial line, and the pair of electromagnetic wave inhibiting sloped surfaces are disposed at positions that coincide with each other in the axial direction of the tube.

6. The duct according to claim 2, wherein the tube includes:

a tube body including an inner peripheral surface parallel to the axial line; and an electromagnetic wave inhibiting portion that is fixed to the inner peripheral surface of the tube body and that forms the electromagnetic wave inhibiting sloped surface.

7. The duct according to claim 2, wherein the tube includes:

a tube body; and an electromagnetic wave inhibiting portion that is fixed to an inner peripheral surface of the tube body and that forms the electromagnetic wave inhibiting sloped surface, and the electromagnetic wave inhibiting portion is formed of an electromagnetic wave absorber that absorbs electromagnetic waves.

8. The duct according to claim 2, wherein a plurality of pairs of the electromagnetic wave inhibiting sloped surfaces are arranged in the axial direction.

9. The duct according to claim 1, further comprising a reinforcing member that has a tubular shape covering the electromagnetic wave selecting inner peripheral member from an outer peripheral side and that reinforces the electromagnetic wave selecting inner peripheral member.

10. The duct according to claim 9, wherein a pair of the electromagnetic wave inhibiting sloped surfaces are disposed facing each other in a direction orthogonal to the axial line, and the pair of electromagnetic wave inhibiting sloped surfaces are disposed at positions that coincide with each other in the axial direction of the tube.

11. The duct according to claim 9, wherein the tube includes:

a tube body including an inner peripheral surface parallel to the axial line; and an electromagnetic wave inhibiting portion that is fixed to the inner peripheral surface of the tube body and that forms the electromagnetic wave inhibiting sloped surface.

12. The duct according to claim 9, wherein the tube includes:

a tube body; and an electromagnetic wave inhibiting portion that is fixed to an inner peripheral surface of the tube body and that forms the electromagnetic wave inhibiting sloped surface, and the electromagnetic wave inhibiting portion is formed of an electromagnetic wave absorber that absorbs electromagnetic waves.

13. The duct according to claim 9, wherein a plurality of pairs of the electromagnetic wave inhibiting sloped surfaces are arranged in the axial direction.

14. The duct according to claim 1, wherein a pair of the electromagnetic wave inhibiting sloped surfaces are disposed facing each other in a direction orthogonal to the axial line, and the pair of electromagnetic wave inhibiting sloped surfaces are disposed at positions that coincide with each other in the axial direction of the tube.

15. The duct according to claim 14, wherein the tube includes:

a tube body including an inner peripheral surface parallel to the axial line; and an electromagnetic wave inhibiting portion that is fixed to the inner peripheral surface of the tube body and that forms the electromagnetic wave inhibiting sloped surface.

16. The duct according to claim 1, wherein the tube includes:

a tube body including an inner peripheral surface parallel to the axial line; and an electromagnetic wave inhibiting portion that is fixed to the inner peripheral surface of the tube body and that forms the electromagnetic wave inhibiting sloped surface.

17. The duct according to claim 16, wherein the electromagnetic wave inhibiting portion is formed of an electromagnetic wave absorber that absorbs electromagnetic waves.

18. The duct according to claim 1, wherein the tube includes:

a tube body; and an electromagnetic wave inhibiting portion that is fixed to an inner peripheral surface of the tube body and that forms the electromagnetic wave inhibiting sloped surface, and the electromagnetic wave inhibiting portion is formed of an electromagnetic wave absorber that absorbs electromagnetic waves.

19. The duct according to claim 1, wherein a plurality of pairs of the electromagnetic wave inhibiting sloped surfaces are arranged in the axial direction.

* * * * *